US005810262A

United States Patent [19]

Ton

[11] Patent Number: 5,810,262

[45] Date of Patent: Sep. 22, 1998

[54] SPA JET WITH INTERCHANGEABLE NOZZLES

[75] Inventor: Thai T. Ton, Lemon Grove, Calif.

[73] Assignee: Watkins Manufacturing Corporation, Vista, Calif.

[21] Appl. No.: 745,441

[22] Filed: Nov. 12, 1996

[51] Int. Cl.[6] ..... E03C 1/084; B05B 3/06

[52] U.S. Cl. ..... 239/428.5; 239/251; 239/261; 239/264; 4/541.4; 601/169

[58] Field of Search ..... 239/226, 246, 239/251, 259, 261, 264, 428.5; 601/169; 4/541.6, 541.4

[56] References Cited

U.S. PATENT DOCUMENTS

| | | | |
|---|---|---|---|
| 3,868,949 | 3/1975 | Arneson | 128/66 |
| 4,349,923 | 9/1982 | Chalberg | 4/542 |
| 4,508,665 | 4/1985 | Spinnett | 261/93 |
| 4,542,853 | 9/1985 | Diamond | 239/428.5 X |
| 4,671,463 | 6/1987 | Moreland et al. | 239/428.5 |
| 4,982,459 | 1/1991 | Henkin et al. | 4/541 |
| 5,014,372 | 5/1991 | Thrasher et al. | 4/542 |
| 5,095,558 | 3/1992 | Howard | 239/428.5 X |
| 5,226,601 | 7/1993 | Hinojosa, Jr. et al. | 239/428.5 X |
| 5,271,561 | 12/1993 | Tobias et al. | 239/289 |
| 5,291,621 | 3/1994 | Mathis | 4/541.4 |

FOREIGN PATENT DOCUMENTS

| | | | |
|---|---|---|---|
| 372-642 | 6/1990 | European Pat. Off. | 4/541.6 |
| 5-23374 | 2/1993 | Japan | 601/169 |

*Primary Examiner*—Lesley D. Morris
*Attorney, Agent, or Firm*—Price, Gess & Ubell

[57] ABSTRACT

A discharge jet assembly for spas including a rear wall fitting, an orifice cap closing the rear wall fitting, and a jet body rotatably mounted within the wall fitting. The rear wall fitting includes a cylindrical central cavity and a vertically disposed air orifice opening into the central cavity. A rear portion of the jet body defines a cylindrical mixing chamber fed by a horizontal cylindrical water inlet and by an air inlet channel formed in the outer circumference of the jet body. The air inlet channel is positioned so as to rotate into and out of communication with the air orifice of the rear wall fitting. The jet body further includes structure for interacting with a stop on the orifice cap so as to appropriately limit rotation of the jet body air inlet channel with respect to the air orifice. An arced continuous seal containment groove and integrally mounted seal surrounds the air inlet channel so as to provide an airtight seal between the rear wall fitting and the jet body. Male retainer elements employing rearward-facing split projections which plug into complementary openings in a female retainer element facilitate mounting of various nozzle styles within the jet assembly. Axial flutes formed in a barrel portion of an eyeball nozzle component provide a flow rate enhancing feature.

10 Claims, 8 Drawing Sheets

SPA JET WITH INTERCHANGEABLE NOZZLES

BACKGROUND OF THE INVENTION

1. Field of the Invention

The present invention relates generally to spas, whirlpools, and similar therapeutic receptacles and, more particularly, to an improved water discharge jet employing interchangeable nozzles.

2. Description of Related Art

It is well-known that a jet of warm or hot water, when directed to a person's limbs and torso, has a pleasing massage effect. The heated water promotes tissue regeneration by increasing the flow of blood to the area and also soothes muscles sore from stress or exertion. Hydromassage has become a common method of treating stress and soreness due to the relaxing nature of the effect. Spas, whirlpools, therapeutic baths, and the like are designed to take advantage of this feature by directing a forced stream of heated water in a tub such that the stream impinges on the occupant. Typically, jets will be mounted in or along the side of a reservoir where the occupant can relax with the jet streams positioned at various locations requiring the treatment.

In the prior art, each jet is typically connected to a supply of pressurized heated water which can be expelled through the jet, and usually includes a mixture of heated water and air. The inclusion of air into the heated water stream has been found to increase the massage effect due to the turbulence which is created. This relaxing effect can be enhanced by altering the delivery of the heated water to produce a pulsating effect, and this enhanced effect can be achieved by either mixing significant amounts of air into the water stream or having the jets rotate in a circular pattern. Water drainage jet structures providing interchangeability of nozzles are also known in the art. Typically, a linear discharge jet may be interchanged with a rotary jet, pulsating jet, or other jet structure. Such prior art jet structures have been overly complicated, for example, in requiring a multiplicity of O-rings and lacking integral air control. Those jet structures which have provided an entrainment feature to increase jet velocity utilize a third chamber within the jet to achieve such operation. Those which provide a rotary jet typically use a purchased rotary bearing added to the structure in a secondary operation, which increases complexity and expense.

OBJECTS AND SUMMARY OF THE INVENTION

It is a first object of the present invention to improve water discharge jet structures;

It is another object of the present invention to simplify the design of water jet discharge jet structures which provide interchangeability of jet nozzles;

It is another object of the present invention to provide a water entrainment feature resulting in increased jet flow rate while avoiding adding chambers or other complications to the jet structure;

It is yet another object of the present invention to reduce the number of O-rings and provide improved sealing structures in an interchangeable nozzle water discharge jet;

It is yet another object of the invention to provide such an improved jet structure which incorporates integral air flow control; and It is still another object of the invention to provide an interchangeable nozzle water jet assembly featuring a simplified rotary jet structure.

In accordance with the present invention, a discharge jet assembly is provided which includes a rear wall fitting, an orifice cap closing the rear wall fitting, and a jet body rotatably mounted within the wall fitting. The rear wall fitting includes a cylindrical central cavity therein and a vertically disposed air inlet having an inner orifice opening into the central cavity. The orifice cap has a circular outer perimeter surrounding an inner face which has a stop member and a centrally located cylindrical pipe section extending therefrom. The cylindrical pipe section defines a portion of a horizontally disposed water entrance channel extending through the orifice cap.

A rear portion of the jet body defines a cylindrical mixing chamber fed by a cylindrical water inlet and by an air inlet channel disposed around a top portion of the circumference of the jet body. The cylindrical water inlet surrounds the cylindrical pipe section of the orifice cap and rotates about the pipe section in sealed relation therewith, the seal preferably being provided by an O-ring. The air inlet channel is positioned so as to rotate into and out of communication with the inner air orifice in the roof of the wall fitting. The jet body further includes means for interacting with the stop on the orifice cap so as to appropriately limit rotation of the jet body air channel with respect to the air orifice of the rear wall fitting.

According to another novel aspect of the invention, the jet assembly may include an arced seal containment groove formed on the jet body around the air inlet channel and a seal means in the containment groove and contoured by the groove so as to provide an airtight seal between the rear wall fitting and the jet body.

According to another aspect of the invention, the jet assembly may further include a female retainer member, an eyeball nozzle, and a male retainer for capturing the eyeball nozzle. The male retainer preferably has rearward-facing split projections which plug into complementary openings in the female retainer and thereby provide for removable attachment of the eyeball nozzle to the female retainer. According to a further novel aspect, axial flutes are provided on a barrel portion of the eyeball nozzle, resulting in an entrainment or flow rate-increasing feature.

Still another novel aspect of the invention is the provision of a rotatable nozzle assembly wherein a cylindrical pipe portion of the nozzle has a bearing race formed directly thereon, thereby resulting in a simplified and better operating nozzle. The preferred design is also directed to eliminating the use of O-rings. The introduction of water through the rear horizontal orifice in particular achieves such an elimination.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved interchangeable nozzle discharge jet.

Figure 1:
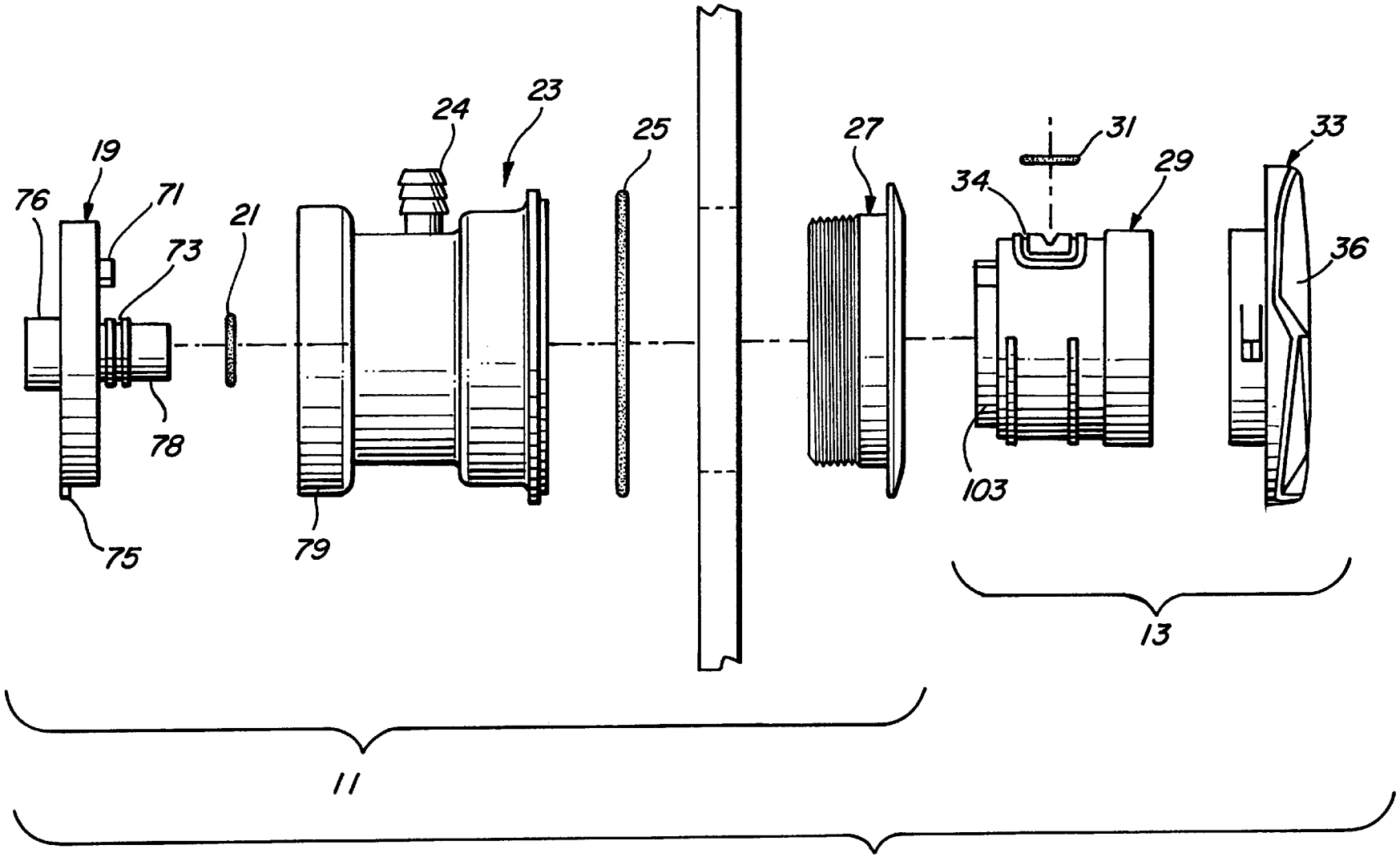
FIG. 1 is an exploded side view illustrating a wall fitting assembly and adjustable body assembly according to the preferred embodiment.
Figure 2:
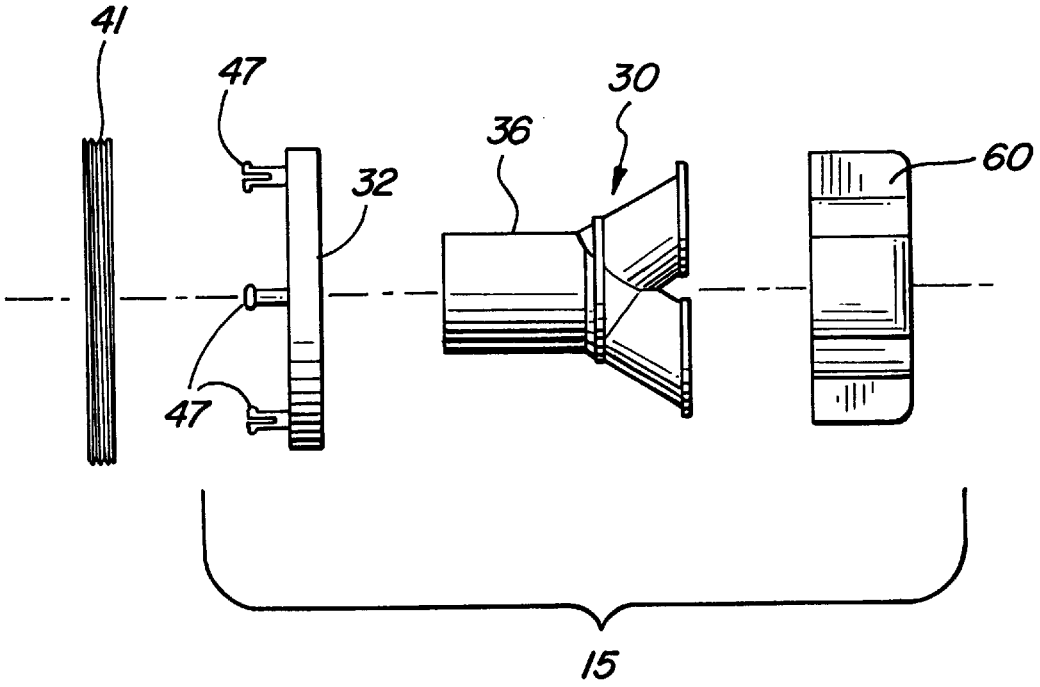
FIG. 2 is an exploded side view of a rotary nozzle assembly according to the preferred embodiment.
Figure 3:
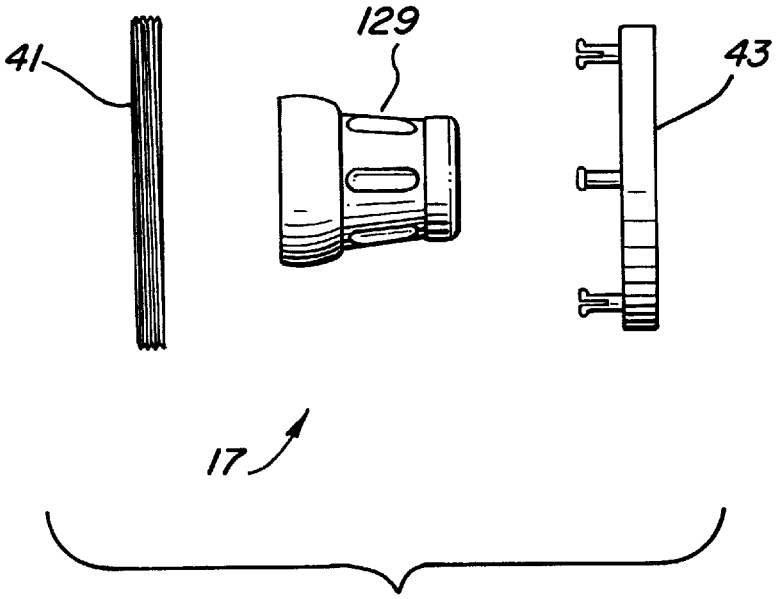
FIG. 3 is an exploded side view of an eyeball nozzle assembly according to the preferred embodiment.

As shown in FIGS. 1–3, the interchangeable spa jet according to the preferred embodiment includes a wall fitting assembly 11, an adjustable body assembly 13, a rotatable nozzle assembly 15 (FIG. 2), and an eyeball nozzle assembly 17 (FIG. 3). As further shown in FIG. 1, the wall fitting assembly 11 includes an orifice cap 19, a rear wall fitting 23, a small O-ring 21, a large O-ring 25, and a front wall fitting 27. Both the orifice cap 19 and the front wall fitting 27 fit concentrically within the rear wall fitting 23. The orifice cap 19 is solvent bonded to seal within the rear wall fitting, while the front wall fitting 27 threads into the rear wall fitting 23. The rear wall fitting 23 further includes a vertical air inlet 24.

The adjustable body assembly 13 includes an adjustable jet face 33, which is sonically welded to an adjustable jet body 29. The jet body 29 mounts to rotate through a selected arc within the wall fitting assembly 11, as described in further detail hereafter. When the jet body 29 is so mounted, an O-ring 31 residing in a rectangular seal containment groove 34 provides a seal about the internal orifice 83 (FIG. 4) of the vertical air inlet 24 ("air orifice seal").

Figure 4:
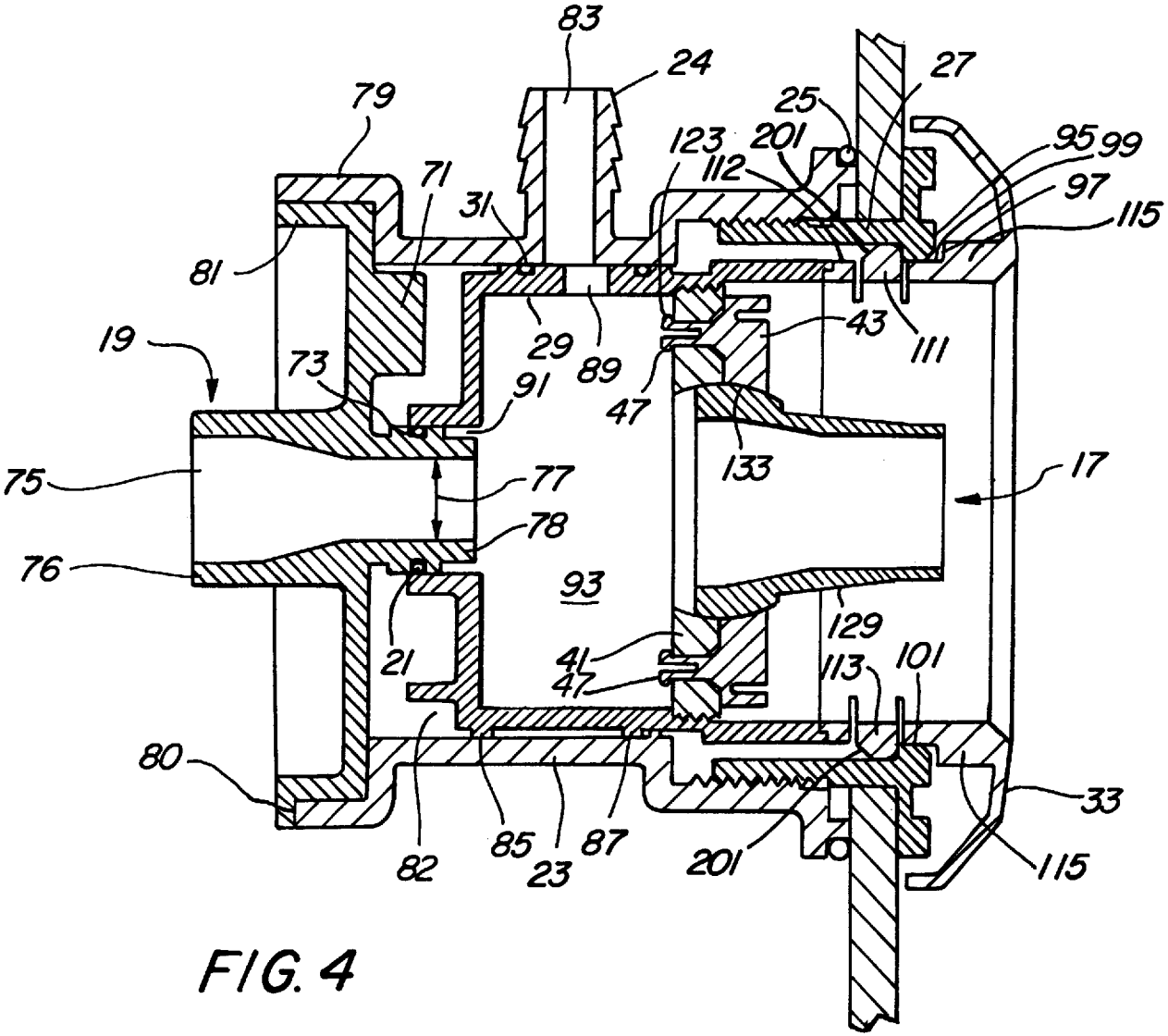
FIG. 4 is a side sectional view of the preferred interchangeable jet assembly with the eyeball nozzle assembly of FIG. 3 installed.

FIG. 4 generally illustrates the wall fitting assembly 11 and the adjustable body assembly 13 in assembled relation with respect to one another with the eyeball nozzle assembly 17 installed in operating position.

Figure 5:
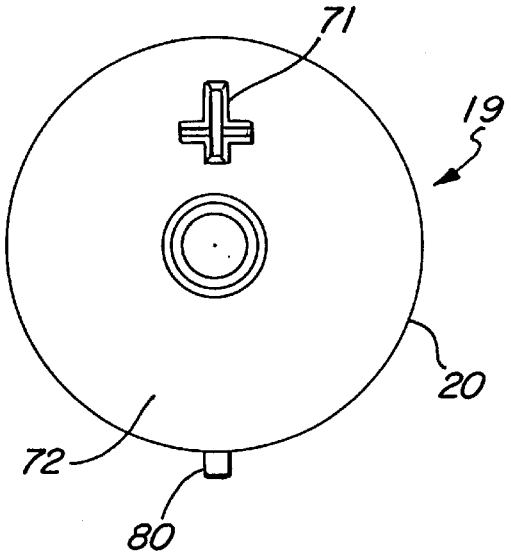
FIG. 5 is a front view of an orifice cap according to the preferred embodiment.
Figure 6:
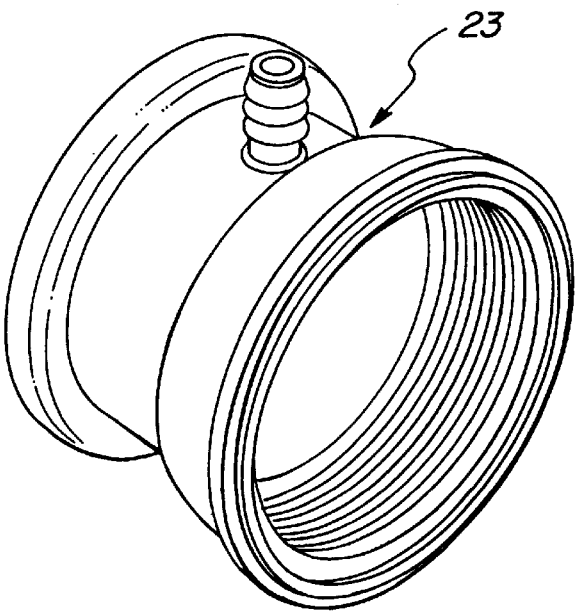
FIG. 6 is a perspective view of a rear wall fitting according to the preferred embodiment.
Figure 7:
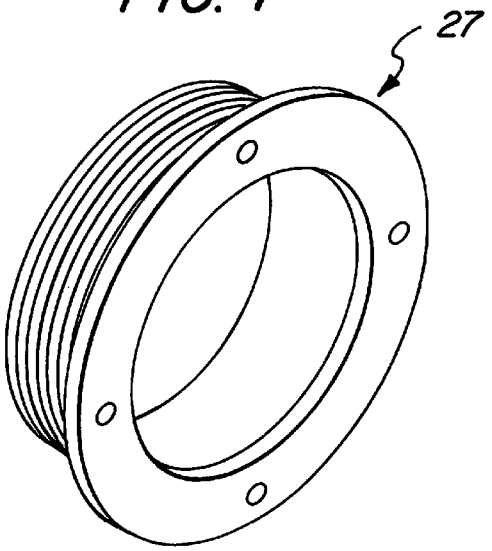
FIG. 7 is a perspective view of a front wall fitting according to the preferred embodiment.

The structure and location of the orifice cap 19 is particularly illustrated in FIGS. 4 and 5. As there shown, the orifice cap 19 has a circular outer perimeter 20 and further has an outer orifice opening 75 and an inner orifice opening 77 formed therein, each of circular cross-section. The outer orifice opening 75 comprises the mouth of an inlet pipe portion 76, while the inner orifice opening 77 comprises the end of a cylindrical outlet pipe 78. The outer orifice opening 75 is wider in diameter (e.g., 0.750-inch) than the inner orifice opening 77 (e.g., 0.400-inch) in order to increase the speed of flow into the mixing chamber 93 of the assembly. The orifice cap 19 further includes a stop 71 formed on its inner face 72 (FIG. 5), which limits the rotation of the adjustable body assembly 13 within the wall fitting assembly 11, as further described below. Finally, the orifice cap 19 is provided with an alignment pin 80 to ensure proper positioning of the orifice cap 19 with respect to the rear wall fitting 23.

The rear wall fitting 23 includes an outer flange portion 79 which mates with the outer annular rim 81 of the orifice cap 19. The rear wall fitting 23 further includes a central cavity 82 of uniform diameter into which the orifice 83 of the air inlet 24 opens.

The adjustable body assembly 13 is positioned and designed to rotate within the central cavity 82 of the rear wall fitting 23 such that an opening 89 in the jet body 29 is positioned to communicate air from the air orifice 83 into the mixing chamber 93 of the jet body 29. A cylindrical rear opening 91 in the adjustable body 29 slidably rotates about the inner orifice opening 77 with a seal being provided by the small O-ring 21. As may be seen, the mixing chamber 93 is of generally rectangular cross-section.

The extent to which the adjustable body assembly 13 extends into the wall fitting assembly 11 is determined by the length of the adjustable body assembly 13 and the abutment between a front face 95 of the front wall fitting 27 and a plurality of stops 115 formed on the jet face 33. Surfaces facilitating rotation of the adjustable body assembly 13 within the wall fitting assembly 11 are provided by semicircular raised bearing surfaces 85, 87 on the adjustable body 29 and by the interface between an outer rim 101 of the front wall fitting 27 and a recessed inner rim 99 of the jet face 33.

Figure 8:
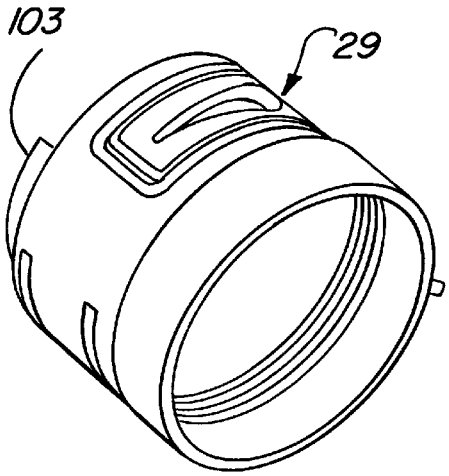
FIG. 8 is a perspective view of an adjustable jet body component according to the preferred embodiment.
Figure 9:
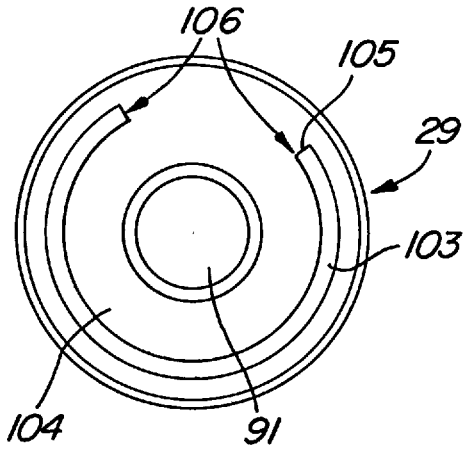
FIG. 9 is a rear view of the jet body of FIG. 8.
Figure 10:
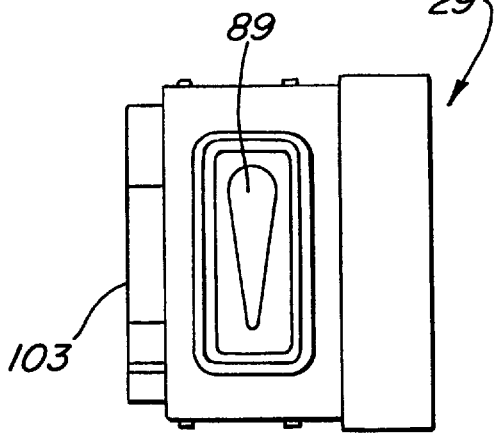
FIG. 10 is a top view of the jet body of FIG. 8.

As shown in FIGS. 8–10, the adjustable jet body 29 has an annular rear rim 103 formed on its back surface 104. The rear rim 103 terminates at edges 105, 107 to form a gap 106. This gap 106 may extend through an arc of, for example, 81 degrees. The edges 105 and 107 operate to limit the degree of rotation of body assembly 13 by interaction with the stop 71 formed on the orifice cap 19. The positioning of the gap 106 is coordinated with the design of the teardrop-shaped opening 89 illustrated in FIG. 10 such that when edge 107 of the rim 103 abuts the stop 71, maximum air flow is provided into the mixing chamber 93, while when edge 105 abuts the stop 71, air flow is completely terminated. It will be appreciated that the complete termination of air flow is facilitated by the complete seal provided by the O-ring 31.

Figure 11:
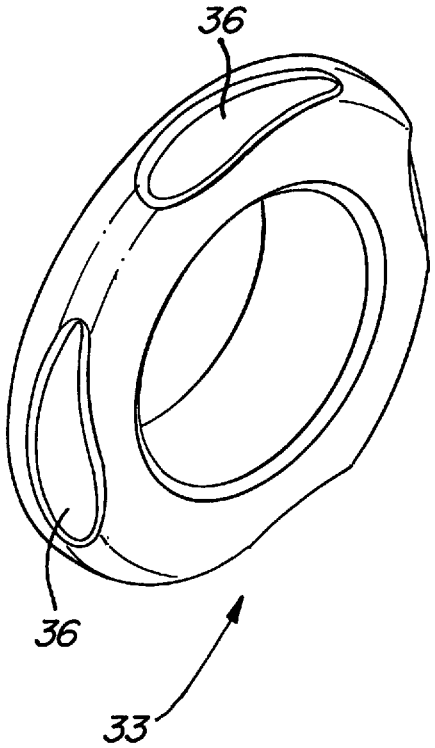
FIG. 11 is a front perspective view of a jet face or bezel according to the preferred embodiment.
Figure 12:
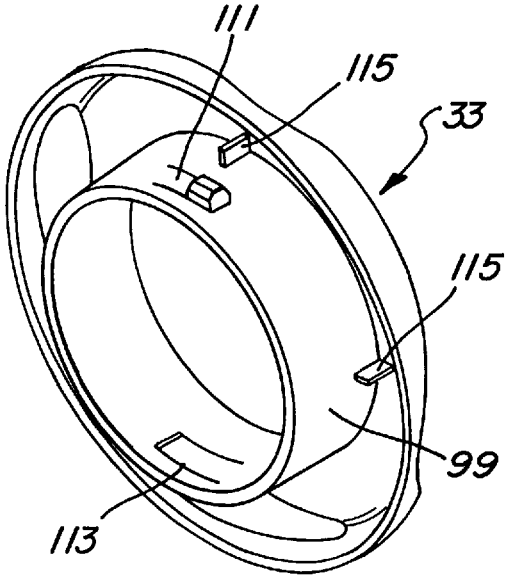
FIG. 12 is a rear perspective view of the jet face of FIG. 11.

FIGS. 11 and 12 further illustrate the jet face 33. As may be seen, an inner annular portion 112 of the jet face 33 includes first and second circumferential tabs 111, 113 diametrically disposed from one another. These tabs 111, 113 exhibit a bias against depression and are arrayed to snap behind an inner ridge of the front face 95 of the front wall fitting 27, as shown in FIG. 4 and, hence, retain the jet face in position, rotatably mounted within the front wall fitting 27. As further shown in FIG. 4, each tab 111, 113 includes a chamfered leading edge 201 which assists in depressing the respective tab as it contacts the front wall face 95 and is inserted into the interior of the front wall fitting 27. This chamfered leading edge 201 also makes the jet face 33 easier to insert than it is to remove. In FIG. 12, the plurality of stop tabs 115 are also shown protruding perpendicularly from the surface of the annular portion 112. Four such stop tabs 115 may be provided spaced 90 degrees apart from one another.

As will be appreciated, the jet face 33 is rigidly attached to the body 29 and provided with knurled or other gripping surfaces 36 so that the spa user may rotate the body 29 by manually turning the face 33. Thus, the jet is "bezel adjustable."

Figure 13:
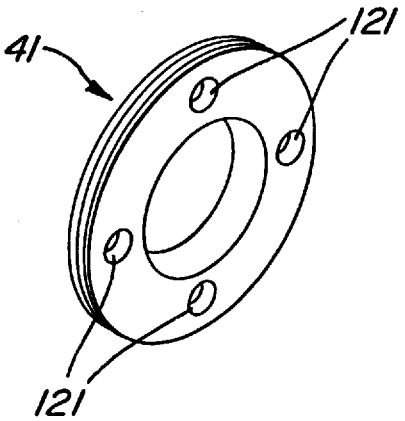
FIG. 13 is a front perspective view of a female retainer according to the preferred embodiment.
Figure 14:
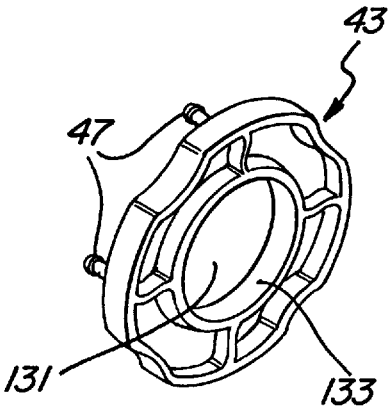
FIG. 14 is a front perspective view of a male retainer according to the preferred embodiment.
Figure 16:
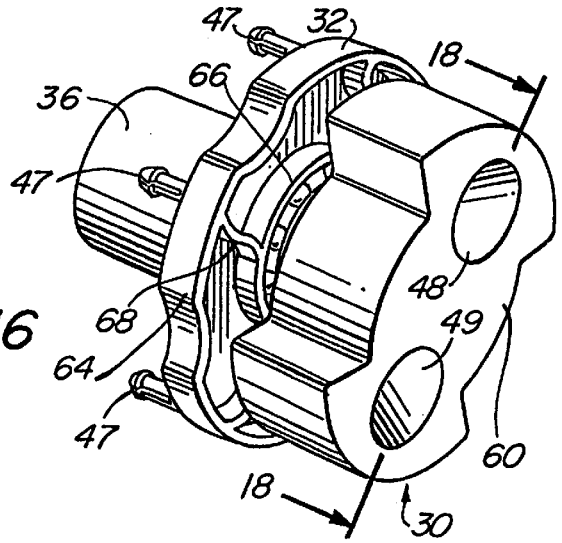
FIG. 16 is a front perspective view of a rotatable nozzle according to the preferred embodiment.

As may be further seen in FIG. 4, the female retainer 41 threads into a threaded portion of the jet body 29 and defines the front surface of the mixing chamber 93. As further seen in conjunction with FIG. 13, the female retainer 41 has a threaded outer perimeter and contains four circular apertures 121 therein, which receive respective split plugs 47 mounted on the rear surface of a suitable male retainer, e.g., 43. The split plugs 123 permit the male retainer 43 to be manually snapped in and out of the female retainer 41. The male retainer 43 illustrated in FIGS. 4, 14, and 16 further contains a central opening 131 having a curved contour 133 thereon which captures a mating surface 134 of the eyeball nozzle 129 and permits it to rotate so that its flow stream may be directed at various angles by the user. Four split plugs 47 are preferably provided to mate with the four complementarily disposed openings 121 in the female retainer 41.

Figure 15:
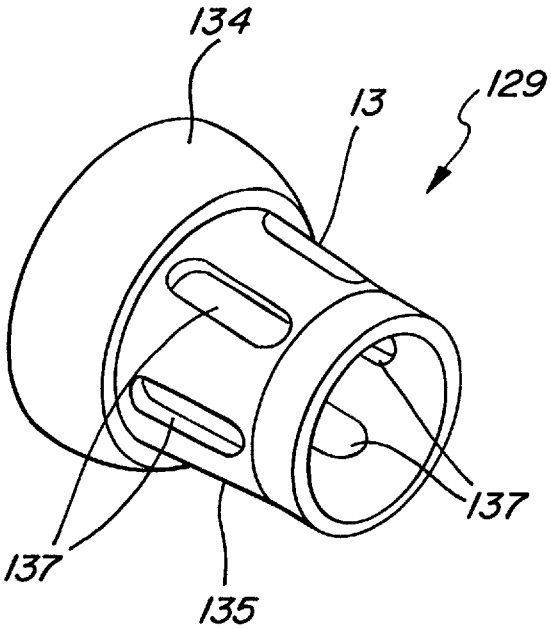
FIG. 15 is a front perspective view of an eyeball nozzle according to the preferred embodiment.

As seen in FIGS. 3 and 15, the barrel 135 of the eyeball nozzle 129 has a number of elongated slots or flutes 137 formed therein and spaced equidistantly from one another about the perimeter of the nozzle 129 and generally parallel to its central axis. It has been found that these slots 137 provide an entrainment function, which can increase flow rate from, for example, 10 gal./min. to 11 or 12 gal./min. about the nozzle 129. The nature of this flow helps to drain stagnant water from about the nozzle 129.

The rotating nozzle assembly 15 is shown in greater detail in FIGS. 16–21. It is preferably molded from a thermoplastic material and comprises a cylindrical pipe section 36, a nozzle 30, and a male retainer or bracket 32. The pipe section 36 forms the inlet 37 of the nozzle 30. The nozzle head 60 has two diverging channels 62, 63 which terminate in respective outlets 48, 49.

Figure 17:
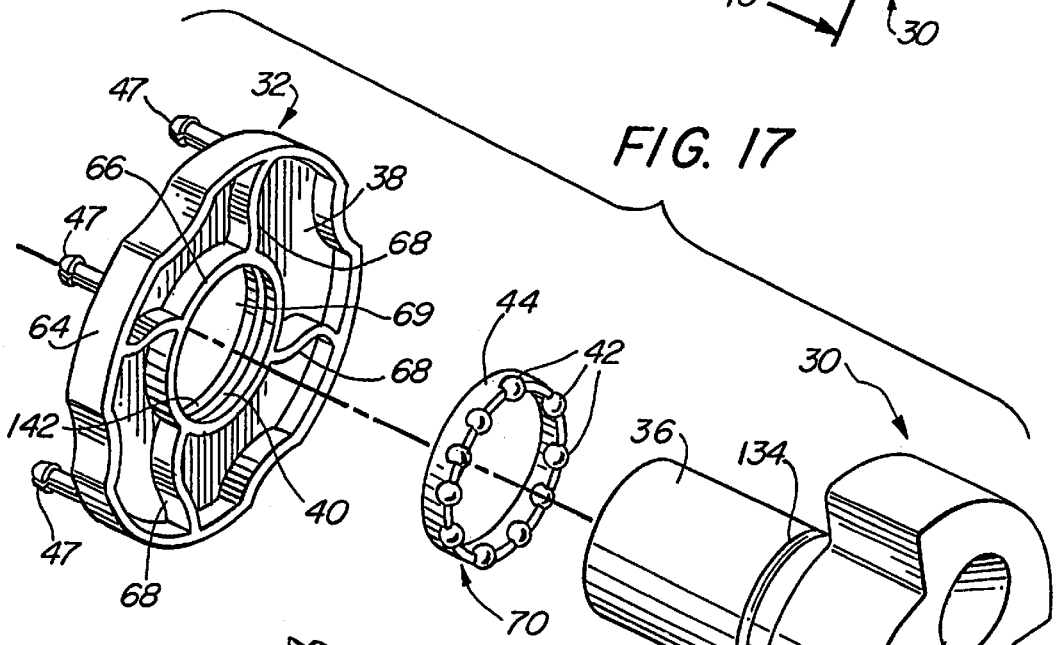
FIG. 17 is an exploded view of the nozzle of FIG. 15.

As shown in FIG. 17, the pipe section 36 has a circumferential recess or undercut 134 formed therein wherein reside bearings 42 of a bearing assembly 70. This assembly 70 further includes a cage 44 which includes circumferential recesses along one edge of the cage 42, which recesses capture and securely hold each of the bearings 42.

The second male retainer 32 has a plate 38 with a scalloped outer rim 64 and a raised circular inner rim 66. These rims 64, 66 are connected by raised undulating spokes 68, which give the male retainer 32 stiffness. The circular inner rim 66 defines a central opening or hole 69, which receives the pipe section 36. The inner surface 142 of the inner rim 66 includes a continuous recess or undercut defining an outer bearing race 40.

The inner race 134 and the outer race 40 provide the raceway for the ball bearings 42. The assembly formed by the bearings 42 and their attached cage 44 is preferably installed by snap-fitting the bearings 42 into the races or undercuts 134, 40. The cage 44 further assists in retaining the bearings 42 within the race, as does a raised outer lip 143 located on the inner rim 142, which further ensures that the bearings 42 will not escape.

Figure 18:
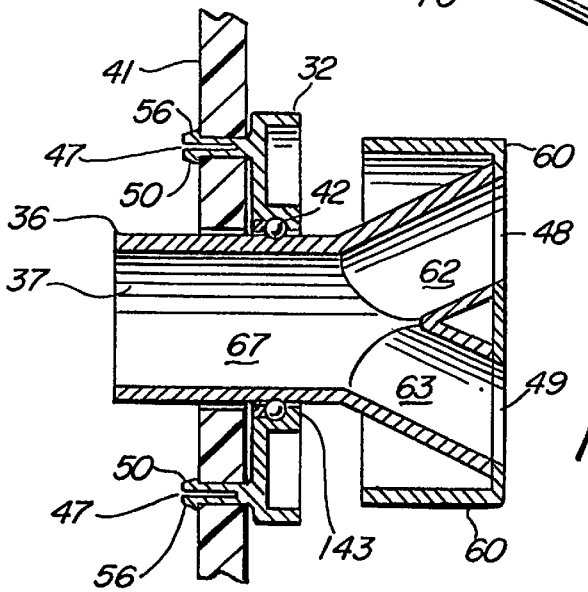
FIG. 18 is a side sectional view of the nozzle taken at 18—18 of FIG. 16.

FIG. 18 illustrates that the only bearing surface of the pipe section 36 is the integrally-formed race 34. FIG. 18 further illustrates that the nozzle 30 is approximately balanced at its point of support by the inner race 34, with the nozzle head 60 on one side and the majority of the nozzle inlet 37 on the opposite side. Such balancing reduces bending moments which result from the cantilevering of the nozzle 30, which discourages undesirable rubbing of the nozzle inlet 37 against the female retainer or other parts.

FIG. 18 further illustrates the preferred method of connecting the mounting bracket 32 to the female retainer 41. The mounting bracket 32 includes a plurality of pegs 47, which protrude perpendicularly to the plate 38 and are directed opposite to the direction of the nozzle head 60. Each peg 47 comprises two resiliently spaced apart fingers 47 with oppositely disposed lips 50, 56, which can be press-fittingly inserted into suitable apertures in the female retainer 41 and which release upon execution of a manually applied pulling force to permit extraction of the rotary nozzle 15 from the structure.

Figure 19:
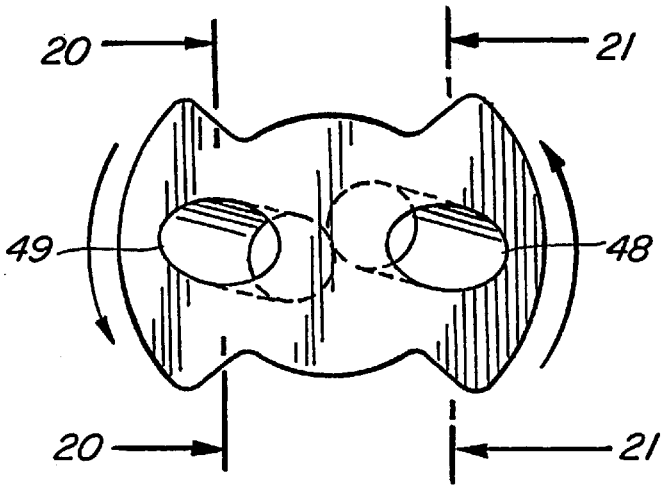
FIG. 19 is a front view of the nozzle component of the nozzle assembly.
Figure 20:
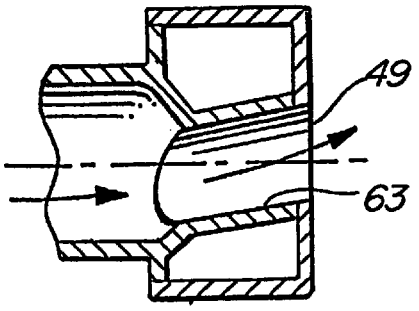
FIG. 20 is a fragmentary cut-away view taken at 20—20 of FIG. 19.
Figure 21:
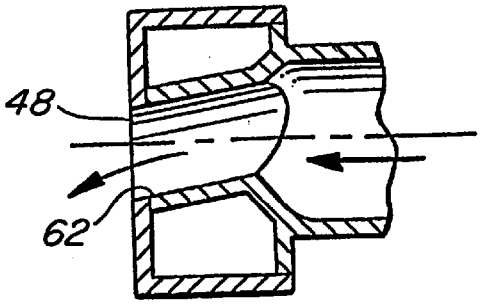
FIG. 21 is a fragmentary cut-away view taken at 21—21 of FIG. 19.

FIG. 19 depicts the face of the nozzle head 60 and illustrates the skewed direction of the outlets 48, 49. When the nozzle head 60 is in the position shown, channel 62 is directed downward and outward, and channel 63 is directed upward and outward. As water passes from each channel's inlet, the radial forces on the walls of the channels 62, 63 cancel, while a downward force is exerted on channel 63 and an upwards force is exerted on channel 62. The resultant of these two forces causes rotation of the nozzle head 60 in the direction shown, as known in the art. FIGS. 20 and 21 further illustrate the outlets 48, 49 and the water's change of direction, which results in the rotational force on the nozzle.

In operation, water under constant system pressure flows into outer orifice inlet 75, has its velocity increased and enters the mixing chamber 93 where air from air inlet 89 is entrained in the fluid stream, provided air inlet 89 is open. The air/water stream is discharged through one of the jet nozzles 30, 129, with accompanying rotation of the rotatable nozzle 30 or increasing of flow speed via the axial slots 137 of the eyeball nozzle 129.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A discharge jet assembly comprising:

a rear wall fitting having a cylindrical central cavity therein and a vertically disposed air inlet having an inner orifice opening into said central cavity;

a generally solid orifice cap having a circular outer perimeter surrounding an inner face attached to an inner end of said rear wall fitting so as to close said end, said inner face having a stop member and a centrally located cylindrical pipe section extending therefrom, said pipe section defining a portion of a horizontally disposed water entrance channel extending through said orifice cap and having an O-ring seat formed about its outer circumference and an O-ring seated therein;

a jet body positioned within said rear wall fitting and having a rear portion defining a cylindrical mixing chamber, said rear portion having a cylindrical inlet extending therefrom and positioned and sized to surround said cylindrical pipe section in sealed relation with said O-ring;

means for mounting said jet body within said rear wall fitting such that said jet body may be rotated with respect to said rear wall fitting;

an air inlet formed across a cylindrical top portion of said jet body and positioned so as to rotate into and out of communication with said orifice upon rotation of said jet body;

said jet body further including means for interacting with said stop means to limit rotation of said jet body with respect to said rear wall fitting, said means for interacting and said air inlet being coordinated in location so as to place a selected portion of said air inlet beneath said orifice.

2. The jet assembly of claim 1 further including:

a continuous, arced seal containment groove formed around and surrounding said air inlet; and means in said containment groove and contoured thereby for providing a continuous seal between said rear wall fitting and said jet body.

3. The jet assembly of claim 1 further including a female retainer member and an eyeball nozzle assembly comprising:

a male retainer having an opening therein having a curved surface thereon;

an eyeball nozzle having a curved surface on a rear portion thereof shaped to mate within said first curved surface; and means for removably plugging said male retainer member into said female retainer so as to capture said eyeball nozzle in said male retainer.

4. The jet assembly of claim 1 further comprising a rotatable nozzle assembly comprising:

a cylindrical pipe having an outer circumferential recess defining an inner bearing race, said cylindrical pipe terminating in a discharge nozzle means for dispelling fluid in a manner to impart a rotational movement to the nozzle about a centerline of the cylindrical pipe;

male retainer means for rotationally mounting said cylindrical pipe and having an opening therein sized to receive said circular pipe, said inner edge having a recess therein defining an outer bearing race; and a plurality of ball bearings disposed between said inner bearing race and said outer bearing race.

5. The jet assembly of claim 2 further comprising a rotatable nozzle assembly comprising:

a cylindrical pipe having an outer circumferential recess defining an inner bearing race, said cylindrical pipe terminating in a discharge nozzle means for dispelling fluid in a manner to impart a rotational movement to the nozzle about a centerline of the cylindrical pipe;

male retainer means for rotationally mounting said cylindrical pipe and having an opening therein sized to receive said circular pipe, said inner edge having a recess therein defining an outer bearing race; and a plurality of ball bearings disposed between said inner race and said outer race.

6. The jet assembly of claim 1 further including a face plate means attached to said jet body and grippable by a user from a position within said reservoir for manually rotating said jet body.

7. The jet assembly of claim 6 wherein said face plate means includes tab means for retaining said face plate means and jet body rotatably mounted with respect to said rear wall fitting.

8. The jet assembly of claim 7 further including stop means on an interior portion of said face plate means for limiting the degree to which said jet body and face plate means are insertable into said rear wall fitting.

9. The jet assembly of claim 3 wherein said eyeball nozzle has a barrel portion and a plurality of flutes therein.

10. The jet assembly of claim 3 wherein said eyeball nozzle has a barrel portion and flute means therein for increasing fluid flow rate about said nozzle.

* * * * *

UNITED STATES PATENT AND TRADEMARK OFFICE

CERTIFICATE OF CORRECTION

PATENT NO. : 5,810,262

DATED : September 22, 1998

INVENTOR(S) : Thai T. Ton

It is certified that error appears in the above-identified patent and that said Letters Patent is hereby corrected as shown below:

Claim 1, column 7, line 15, after "stop", change "means" to —member—.

Claim 3, column 7, line 4, before "curved", insert —first—.

Claim 4, column 8, line 3, after "nozzle", insert —means—.

Claim 4, column 8, line 6, substitute —cylindrical— for "circular".

Claim 5, column 8, line 17, after "nozzle", insert —means—.

Claim 5, column 8, line 20, after "said", insert —male retainer means having an—.

Claim 4, column 8, line 6, after "said,(second occurence) insert --male retainer means having an--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*